United States Patent [19]

Sampson

[11] Patent Number: 4,706,330

[45] Date of Patent: Nov. 17, 1987

[54] AUTOMATIC CLOSING ACTIVATOR

[76] Inventor: Ronald Sampson, 7/26-28 Kairawa Street, South Hurstville, New South Wales, 2221, Australia

[21] Appl. No.: 831,151

[22] Filed: Feb. 19, 1986

[30] Foreign Application Priority Data

Feb. 20, 1985 [AU] Australia ..... 53775/86

[51] Int. Cl.[4] ..... E05F 15/20

[52] U.S. Cl. ..... 16/48.5; 16/78; 49/379

[58] Field of Search ..... 16/48.5, 71, 78, 72; 148/402; 428/960; 49/379, 386; 62/265

[56] References Cited

U.S. PATENT DOCUMENTS

| | | | |
|---|---|---|---|
| 1,860,333 | 5/1932 | Dunn | 16/DIG. 17 X |
| 3,143,773 | 8/1964 | Glenn | 16/78 X |
| 3,516,082 | 6/1970 | Cooper | 428/960 X |
| 3,883,885 | 5/1975 | Orlando | 428/960 X |
| 4,010,455 | 3/1977 | Stange | 428/960 X |
| 4,366,595 | 1/1983 | Elliott | 16/71 |

FOREIGN PATENT DOCUMENTS

| | | | |
|---|---|---|---|
| 200744 | 11/1984 | Japan | 148/402 |
| 2043764 | 10/1980 | United Kingdom | 16/48.5 |

OTHER PUBLICATIONS

Johnson, Dr. A. D., Proceedings of the NITINOL Heat Engine Conference-"Training", Phenomena in NITINOL, Silver Spring, Md., Sep. 26-27, 1978.

*Primary Examiner*—M. Jordan
*Assistant Examiner*—Carmine Cuda
*Attorney, Agent, or Firm*—Brumbaugh, Graves, Donohue & Raymond

[57] ABSTRACT

This invention concerns a traction device such as a door closure made from memory alloy. In the preferred form the traction device comprises an elongated length of memory alloy, heating means operable to heat the element to restore it to its original shape, relatively movable parts attached to respective ends of the element, one of which is connected to a load which is to be displaced in the direction of traction when the element is heated, and a spring which yields resiliently to allow the load to move in the direction opposite to that in which traction is exerted if the element is hot.

7 Claims, 5 Drawing Figures

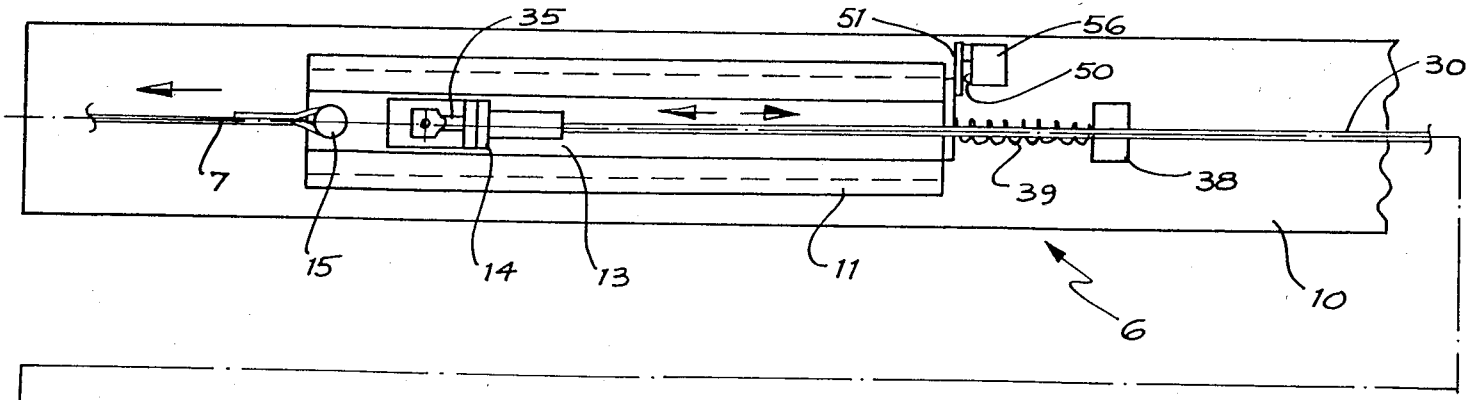
FIG. 2
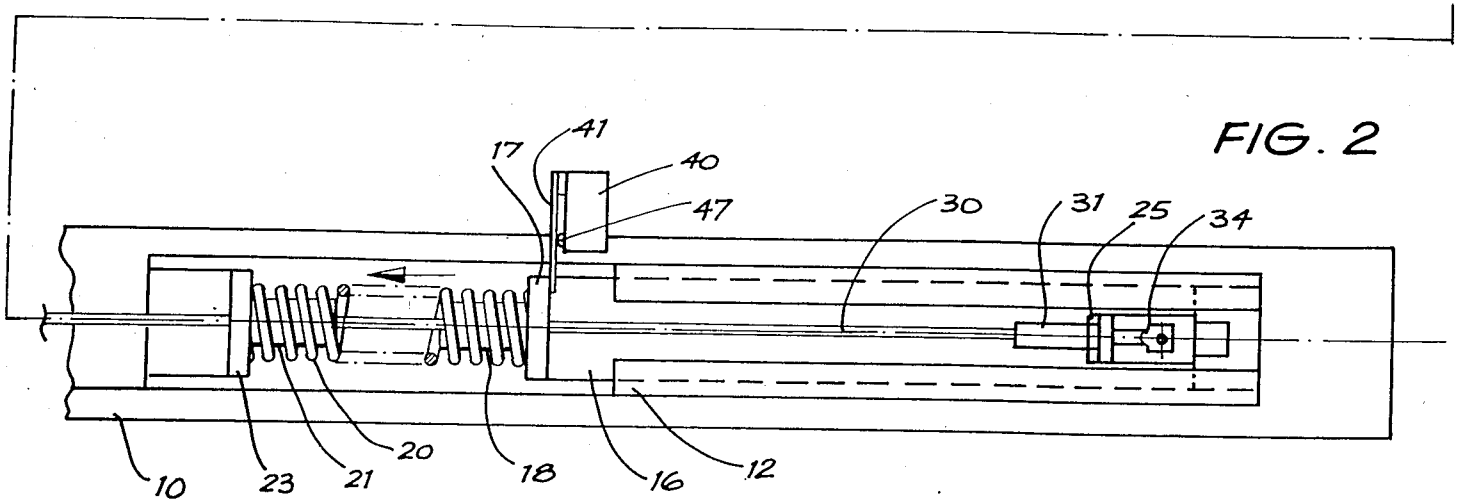

AUTOMATIC CLOSING ACTIVATOR

FIELD OF THE INVENTION

This invention is concerned with a traction device of elongated form which is cheap to manufacture and reliable in operation. The device is particularly, although not exclusively, suited to closing doors automatically following a short delay after they have been opened. For example, it is convenient to have the doors of refrigerated-cubicles provided with self-closing doors so that they do not remain open longer than is necessary.

The traction device of the invention is also usable in other applications, such as providing a door-opening mechanism where there is a demand for a strong traction force to be applied over a short distance.

BACKGROUND OF THE INVENTION

Traction devices providing a strong force over a short distance are either electrically, hydraulically or mechanically operated. Devices using an electric motor to provide traction are relatively expensive. The same is true of hydraulically-operated devices, as close-fitting moving parts and pressure seals are necessary. Mechanical devices, using springs or gravity, are cheap to install but have the disadvantage that they represent an additional load which has to be overcome at times when traction is not required.

SUMMARY OF THE INVENTION

An object of this invention is to provide a traction device operated by temperature and which provides a negligible resistance to movement of the load when the traction device is not operated.

In accordance with the present invention there is provided a temperature-operated traction device which comprises an elongated element made from a heat-responsive memory material of the type defined below, heating means operable to heat the element to restore it to its original shape, two relatively movable parts attached to respective ends of the element and the first of which is connected to a load which is to be displaced in the direction of traction when the element is heated, and a spring which yields resiliently to allow the load to move in the direction opposite to that in which traction is exerted if the element is hot.

Recent developments in metal alloys have created materials which, when cold, are remarkable ductile and can have their shape altered easily from an "original" shape by applying a small traction force. However, when such a material is heated above a certain temperature, it reassumes its original shape and, in so doing, is capable of exerting a very much greater force than that required to alter its shape when cold. Such a material is referred to throughout this specification as being "a heat-responsive memory material of the type defined". Examples of such materials are to be found in U.S. Pat. Nos. 4,412,872 and 4,405,387 hereby inserted by way of reference, and as a product commercially available in the United States of America under the Trade Mark NITINOL.

In the preferred embodiment of the invention the element is of elongated form, such as a wire or a ribbon, and the load applied when the element is cold causes it to extend from its original length as its ductility is relatively high. On heating the element, the ductility falls and the element shrinks back to its original shape.

In a second embodiment of the invention the element is formed as an "L"-shape and the force applied by the load when the element is cold and ductile, causes the element to bend so that the included angle of the "L" is increased.

When the element is heated, it loses ductility and re-assumes its formed shape. The reduction in the angle of the "L" which occurs, exerts traction on the load.

Suitably the element is heated by an electrical current passed through it when traction is required. The advantage of heating the element this way is that the magnitude of the current can be precisely controlled to provide the requisite heating, and timing circuits are readily available to ensure that a required delay is incurred before the device exerts any traction. Also some loads have a non-linear characteristic and require more traction to be exerted to give them initial movement than is necessary to sustain their movement. An electrical current control circuit is readily devisable by a competent electrical engineer to provide the current with characteristics which cause the element to have the desired traction characteristics.

Conveniently a second spring is provided to keep the element, which may be a wire or a strip, taut, irrespective of the spacing between the two parts connected to its opposite ends.

BRIEF DESCRIPTION OF THE DRAWINGS

The invention will now be described in more detail, by way of examples, with reference to the accompanying drawings, in which:

FIG. 2 shows the traction device of FIG. 1 in a partially broken away plan view;

DESCRIPTION OF PREFERRED EMBODIMENT

Figure 1:
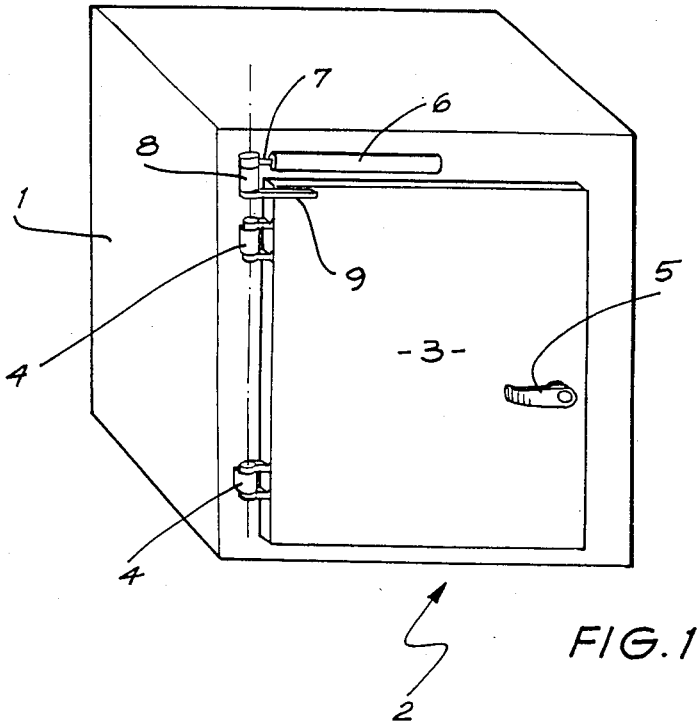
FIG. 1 is a diagrammatic perspective view of a refrigeration cubicle having an opening closed by a door which is restored to its closed position automatically by a traction device after it has been open a predetermined time.

FIG. 1 shows a refrigerated cubicle 1 having an opening 2 closed by a door 3 turning on hinges 4 and having a handle 5. The door 3 opens outwardly and a traction device 6 is mounted on the cubicle 1 immediately above the door 3. A flexible tie 7 extends from one end of the device 6 into a door-closing mechanism 8 having an arm 9 which bears at its end on the door 3 to close it when the traction device 6 is operated. The mechanism 8 can be of any suitable design. In one arrangement (not shown) it contains a pulley having an upright axis and around which the free end of the tie 7 is wound. The pulley is integral with an axle and the arm 9 so that when the device 6 is operated, the tension in the tie 7 rotates the pulley and turns the end of the arm in contact with the door in the door-closing direction. A spring (not shown) retains the end of the arm in contact with the door.

Figure 3:
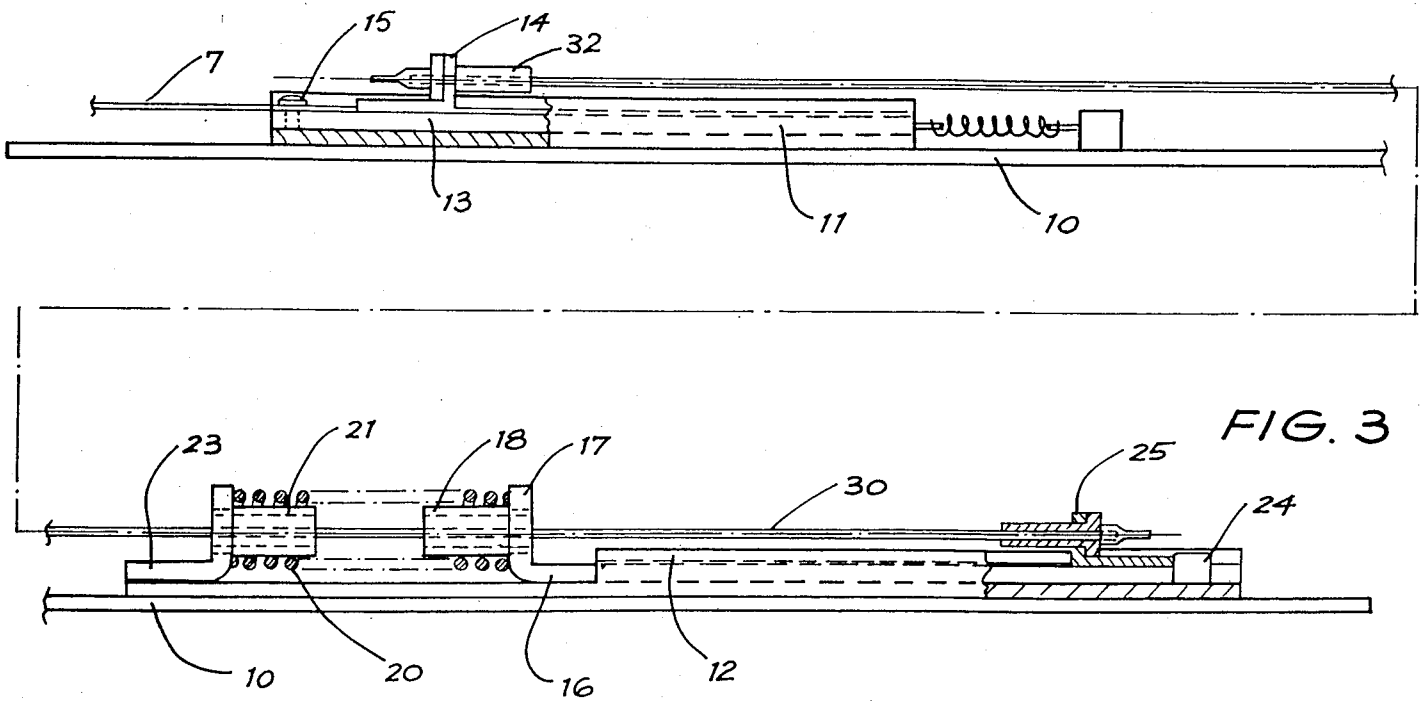
FIG. 3 is a side view of the partially broken away traction device of FIG. 2.

FIGS. 2 and 3 show the construction of the traction device 6 in detail. It comprises an elongated, shallow, rectangular box 10 bolted to the cubicle 1 and containing two axially aligned slideways 11 and 12 respectively. The slideway 11 contains a slide 13 having an apertured angle bracket 14 welded to it and provided with an anchorage 15 to enable the tie 7 to be secured to it.

The slideway 12 contains a slide 16 having an upturned apertured lug 17 equipped at one side with a collar 18 locating one end of a coil compression spring 20. The other end of the spring 20 locates on a second, similar collar 21 attached to an apertured angle piece 23 which is welded to the floor of the slideway 12.

The spring 20 urges the slide 16 against an end stop 24. Adjacent the stop 24, the slide 16 has welded to it a second angle bracket 25 having an aperture which is aligned with the apertures in the lug 17, the angle piece 23 and the angle bracket 14.

A wire 30 made from said heat-responsive memory material of the type defined, extends parallel to the slideways 11 and 12, and passes through the aforesaid apertures. The wire 30 extends at one end through an insulating ferrule 31 in the angle bracket 25 and at the other end through a second insulating ferrule 32 in the angle bracket 14. The portions of the wire 30 projecting from the remote ends of the ferrules 31 and 32 have electrical connectors 34 and 35 crimped to them to enable an electrical heating current to be passed through the wire when the traction device is to be operated.

The box 10 is provided between the two slideways 11 and 12 with a block 38 which locates one end of a relatively weak compression spring 39. The other end of the spring 39 is attached to the slide 13 to bias it continuously away from the slide 16 so as to keep the wire 30 taut. The spring 39 is not strictly necessary, but ensures that the wire does not contact uninsulated parts of the box 10 should it slacken.

A microswitch 40 having a contact 47 in a circuit-closed condition is provided beside the slide 12 and carries a cantilever spring 41 which allows the microswitch 40 to assume a contact-open condition and break the circuit if the lug 17 is moved towards the angle piece 23 from the position shown.

A second microswitch 56 is provided with a cantilever spring 51 which allows a contact 50 to assume a circuit-closed condition if the slide 13 moves to the left of the position illustrated. As long as the wire 30 is in its fully-shrunk state, the cantilever spring is engaged so that the microswitch contact 50 is in its circuit-open condition.

Figure 4:
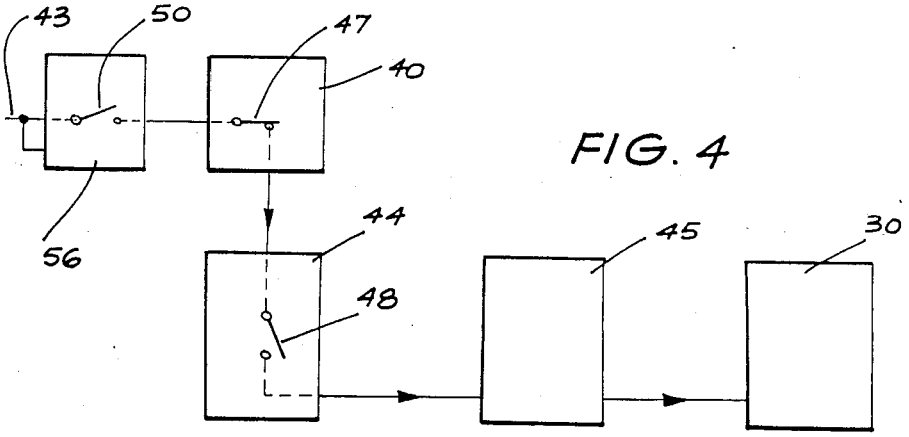
FIG. 4 is a block circuit diagram of an electrical circuit used to operate the device; and, FIG. 5 shows diagrammatically principal operative parts of a second form of traction device, in full outline when a heat-responsive memory element is in its original shape, and in broken outline when the element is in its altered shape.

FIG. 4 shows in block form a control circuit used with the device. Power is provided at 43 to contacts 50 and 47 which are connected electrically in series. If contact 50 is closed, the closure of contact 47 will allow current to flow to a time delay circuit 44 having a contact 48 which closes after a predetermined period to supply current to a current waveform generator 45. The generator 45 supplies an electrical current having required characteristics to cause the wire 30 to heat at a prdetermined rate to a predetermined temperature sufficient to cause the wire 30 to shrink and exert traction on the tie 7.

The operation of the traction device to close the door 3 when open will first be described. As the door 3 is open, the wire 30 is in its extended condition and the slide 13 is spaced from the microswitch 56 so that the contact 50 is closed. This causes a heating current to flow via the closed contact 47, time delay contact 48 and the current waveform generator 45 to the wire 30, heating it to its shrinkage temperature. The end of the wire 30 attached to the slide 16 may be regarded as being fixed if the door is free to close. The heating of the wire causes it to shrink to its original length, drawing the slide 13 towards the slide 16 so that traction is exerted on the flexible tie 7. This causes the mechanism 8 to operate to close the door 3. When the door is closed, the slide 13 engages the cnatilever spring 51 causing the contact 50 of the microswitch 56 to de-energise the power supply circuit.

Should the wire 30 continue to shrink a small amount after the door 3 has completely closed, this final shrinkage is accommodated by movement of the slide 16 towards the angle bracket 23 and compression of the spring 20. However, as the power circuit is now interrupted, the wire 30 cools and becomes more ductile. The spring 20 is then able to extend the wire 30 slightly, to bring the slide 16 against the end stop 24 and cause the cantilever spring 41 to re-close the contact 47 of the microswitch 40.

If the door is now opened after the wire 30 has cooled, the tensile loading on the tie 7 causes the cold wire 30 to extend easily as it has a low ductility when cold, and thus offers a negligible resistance to door opening. Opening of the door is accompanied by movement of the slide 13 to the left in FIGS. 2 and 3, so that the cantilever spring 51 associated with the microswitch 56 operates to close the power circuit to the time-delay circuit 44. This closes the contact 48 after a predetermined period, so that the wire is again heated and door-closing re-occures as described above.

It can happen that the closure of the door is obstructed. In this case, slide 13 cannot move and the shrinkage of the wire 30 causes the slide 16 to move against the compression of the spring 20. The lug 17 then operates the microswitch 40 to open the contact 47 so that the power circuit to the wire 30 is interrupted before the components of the traction device or the object obstructing closure of the door can be subjected to a damaging force.

It can also happen that the door 3 is momentarily partially opened and then reclosed manually. In this event the cold wire is extended and then left slack. However the action of the spring 39 is to move the slide 13 is a direction which keeps the wire 30 taut and this causes the contact 50 of the microswitch 56 to close. This initiates operation of the time delay circuit 44 so that its contact 48 closes after a time delay and the wire is heat shrunk back to its "normal" length, despite the door being closed. The contact 50 is then moved by the slide 13 to its open-circuit condition shown in FIG. 4.

A third condition can arise if the door 3 is opened immediately after it has been closed, or an attempt is made to open it fully when the traction device is actually closing the door. In this case, the hot wire 30, no longer being ductile, cannot extend and, instead, the pull of the tie 7 is applied through the hot wire to the slide 16 which slides to compress the spring 20. The microswitch 40 is then operated so that is contact 47 interrupts the current circuit to the wire 30 which then cools and once again becomes ductile. This allows the spring 20 to extend the wire 30 until the contact of the microswitch 40 is again closed and the wire can be heated to shrink and return the door to its closed position.

In place of the wire 30, a flat strip of the material can be used. This enables a shallower box 10 to be used. Also the springs 20 and 39 can be located in other positions from those indicated in the drawings. Finally, although the invention has been specifically described with reference to a device for closing a door, it can be used to open a door or other form of closure, or to do any other form of work in which a high tractive force, with suitable safety features, is required to perform work over a relatively short stroke.

Figure 5:
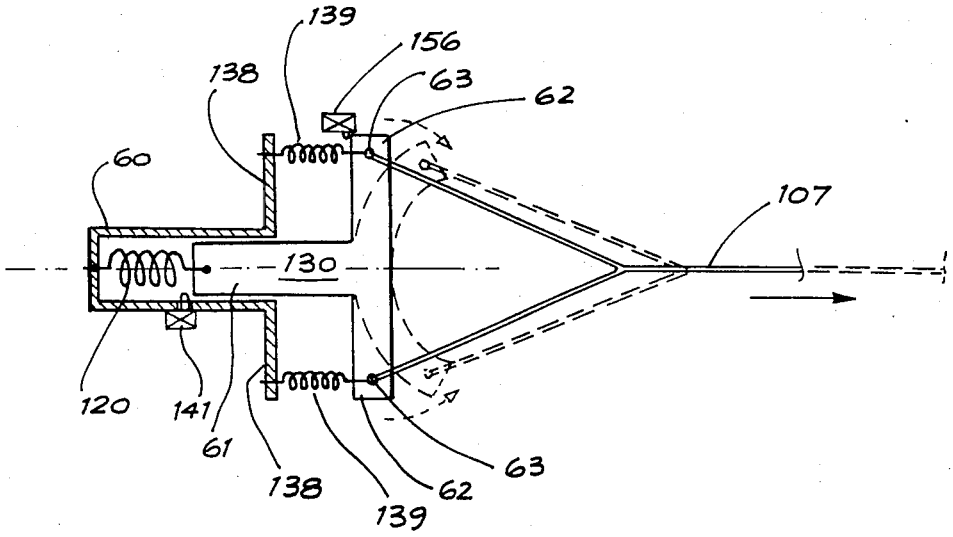

FIG. 5 shows a traction device in which component parts having the same functions as thos already described are similarly referenced but in the hundred series. For convenience the electronic circuitry is omitted as it is the same as that already described. Also omitted are the details of the electrical switches corresponding to switches 40 and 56 of the earlier described embodiment, although the positions of these switches are shown at 141 and 156.

The traction device of FIG. 5 comprises a tubular socket piece 60 having adjacent the mouth of the socket a pair of oppositely extending wings 138. The socket piece 60 contains a stiff tension spring 120 attached at one end to the base of the socket and at the other end to a stem 61 of a T-shaped element 130. The head of the element 130 provides two arms 62 each extending parallel to one of the wings 138. Two tension coil springs 139 respectively extend between each arm 62 and the wing 138 alongside it.

The free ends of the arms 62 are apertured to provide anchorages 63 for a Y-shaped flexible tie 107 connected to a load as described in the earlier embodiment. Each arm 62 may be considered as forming with the stem 61 an L-shaped member.

The element 130 is made from the heat-responsive memory material of the type defined. It is therefore ductile and easily bent when cold. However when hot the element loses ductility and will exert considerable force in attempting to re-assume the shape shown in full outline, if bent from that shape to the shape shown in broken outline when cold.

The application of the tensile loading to the tie 107 causes the arms 62 of the element 130 to bend to the position shown in broken outline in which the element 130 assumes a Y-shape. To restore the shape of the element 130 to a T-shape, it is heated. Its ductility then reduces also so that as its arms 62 return to the position shown in full outline, they exert traction on the load.

The fundamental difference between the two embodiments of the invention described, is that the first embodiment exerts traction by shrinking the element 30 whereas the second embodiment exerts traction by bending of the element 130.

I claim:

1. A temperature-operated traction device comprising an elongated element made from a heat-responsive memory material, said elongated element capable of deforming when in an unheated state in response to a force exerted by a load, and exerting a traction force by returning to its original shape when an electrical heating current is passed therethrough, electrical circuit means for automatically passing said electrical heating current for a predetermined time through said elongated element after it has been deformed in its unheated state to restore it to its original non-deformed shape; two relatively movable slides, each movable along an associated slideway extending parallel to said elongated element, said slides adapted to move along said slideways to assume relative positions in response to a change in shape of said elongated element, a first one of said slides being adapted to be connected to the load to displace said load in the direction of tractoin when said elongated element is heated; a spring extending between an upstanding anglepiece affixed to the floor of a second one of said slideways and an end of said second slide adjacent said first slide, said spring yielding resiliently so as to allow said load to move in a direction opposite to that in which traction is exerted when said elongated element is heated by said electrical heating current; and a first electrical contact which prevents activation of said electrical heating current unless said second slide is at a relative position corresponding to said elongated element being in its unheated state.

2. The traction device as in claim 1, further comprising a second electrical contact which prevents activation of said electrical heating current when said slides are at relative positions corresponding to said elongated element being fully shrunk.

3. The traction device as in claim 1 or 2, further comprising electrical time-delay means responsive to said two slides being moved apart by delaying activation of said electrical heating current until a predetermined period has elapsed.

4. The traction device as in claim 3, further comprising a second spring adapted to act upon said first slide to maintain said elongated element taut in all relative positions of said two slides.

5. The traction device as in claim 1, wherein said elongated element is a wire which shrinks in length when heated to apply traction to said load.

6. A temperature-operated traction device comprising an elongated element made from heat responsive memory material wire; electrical circuit means for passing an electrical heating current through said wire to restore it to its original shape after it has been stretched when in an unheated state; two longitudinally-aligned, relatively movable slides, each slidably movable along an associated slideway extending parallel to said wire, a first one of said slides being connected to a load to be displaced in the direction of traction when said wire is heated, a first compression spring extending between an upstanding anglepiece affixed to the floor of a second one of said slideways and an end of said second slide adjacent said first slide, said spring acting to allow said load to move in a direction opposite to that in which traction is exerted when said wire is in the heated condition; a first electrical contact which prevents activation of said electrical heating current unless said second slide is at a position it occupies when said wire is in an unheated state; a second electrical contact which prevents activation of said electrical heating current when said slides are at relative positions corresponding to said wire being fully shrunk; time-delay means which responds to said two slides being moved apart by delaying activation of said electrical heating circuit until a predetermined period has elapsed; and a second compression spring, of strength lower than that of said first compression spring, adapted to act upon said first slide to maintain said wire taut in all relative positions of said two slides.

7. A temperature-operated traction device comprising a T-shaped element made from a heat responsive memory material, said T-shaped element capable of deforming when in an unheated state in response to a force exerted by a load, and exerting a traction force by returning to its original shape when an electrical heating current is passed therethrough, electrical circuit means for automatically passing said electrical heating current for a predetermined time through said T-shaped element after it has been deformed in its unheated state to restore it to its original non-deformed shape; a flexible tie having a first end adapted to connect to said load and a Y-shaped second end, the free ends of which are fixedly attached to the respective arms of the T-shaped element, whereby the arms of the T-shaped element are bent in the direction of force exerted by said load when said T-shaped element is in an unheated state, a socket element having a cavity for slidably housing the stem of the T-shaped element including a spring fixedly attached to a base of said cavity and the stem of the T-shaped element for allowing said load to move in a direction opposite to that in which traction is exerted when said T-shaped element is heated and oppositely positioned wings for operatively engaging said arms of said T-shaped member by attachment means, a first electrical contact to prevent activation of said electrical heating current unless said arms of said T-shaped member and said wings of said socket element are at relative positions corresponding to said T-shaped element being fully shrunk, and a second electrical contact to prevent activation of said electrical heating current unless said stem of said T-shaped member is at a position it occupies when said T-shaped member is in an unheated state.

* * * * *